US011286935B2

(12) United States Patent
Mikulic

(10) Patent No.: US 11,286,935 B2
(45) Date of Patent: Mar. 29, 2022

(54) SCREW COMPRESSOR INCLUDING CONTROL SLIDERS THAT COOPERATE TO FORM AN INFLOW CHAMBER FOR INFLOW FROM A COMPRESSION CHAMBER AND WITH ONE SLIDER PROVIDED WITH AN OUTFLOW OUTLET

(71) Applicant: BITZER Kuehlmaschinenbau GmbH, Sindelfingen (DE)

(72) Inventor: Tihomir Mikulic, Holzgerlingen (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 328 days.

(21) Appl. No.: 16/152,019

(22) Filed: Oct. 4, 2018

(65) Prior Publication Data

US 2019/0032661 A1 Jan. 31, 2019

Related U.S. Application Data

(63) Continuation of application No. PCT/EP2016/057534, filed on Apr. 6, 2016.

(51) Int. Cl.
*F04C 28/18* (2006.01)
*F04C 28/12* (2006.01)
(Continued)

(52) U.S. Cl.
CPC ..... *F04C 28/185* (2013.01); *F04C 18/023* (2013.01); *F04C 18/16* (2013.01); *F04C 28/12* (2013.01)

(58) Field of Classification Search
CPC ..... F04C 28/185; F04C 28/12; F04C 18/16; F04C 18/023; F04C 28/125; F04C 14/26;
(Continued)

(56) References Cited

U.S. PATENT DOCUMENTS 4,516,914 A 5/1985 Murphy et al.
2008/0304990 A1* 12/2008 Andersen ..... F04C 28/125 418/19
(Continued)

FOREIGN PATENT DOCUMENTS

DE 102015116324 A1 * 4/2016 ..... F04C 28/20
JP S59188076 A 10/1984
(Continued)

OTHER PUBLICATIONS

Derwent English Abstract of DE 10 2015 116 324 A1 (Year: 2016).*

*Primary Examiner* — Mary Davis
*Assistant Examiner* — Paul W Thiede
(74) *Attorney, Agent, or Firm* — Reinhart Boerner Van Deuren P.C.

(57) ABSTRACT

A screw compressor includes two screw rotors and two control sliders that are arranged one behind the other in a slider channel. The control sliders have a combined position with mutually facing end surfaces sealing tightly with each other, and being movable together and have a separated position, with positionable spacing from one another, forming an intermediate space. In a transfer position between the combined and separated positions, the control sliders form an inflow chamber into which the medium to be compressed flows out of one of the compression chambers by passing between the mutually facing end surfaces of the control sliders. One of the control sliders is provided with at least one outflow outlet that is adjacent to the inflow chamber and through which the medium from the inflow chamber enters an outflow opening in the slider channel that overlaps with the outflow outlet in this transfer position.

24 Claims, 14 Drawing Sheets

(51) Int. Cl.
*F04C 18/16* (2006.01)
*F04C 18/02* (2006.01)

(58) Field of Classification Search
CPC ..... F04C 2240/30; F04C 2240/56; F04C 2240/81; F04C 28/20; F04C 18/02; F04C 23/008; F04C 28/06; F04C 29/005; F04C 29/0064; F04C 28/28; F25B 1/04; F25B 2400/0401; F25B 2600/0251; F25B 2600/13; F25B 31/02; F02D 41/0007; F01C 11/008; F01C 20/10; F01C 20/12; F02B 33/38; F02B 33/44; Y02T 10/144
USPC ..... 418/201.1, 201.2, 159; 417/309, 310; 123/564, 559.1
See application file for complete search history.

(56) References Cited

U.S. PATENT DOCUMENTS

| | | | | |
|---|---|---|---|---|
| 2011/0083432 | A1 | 4/2011 | Hansen et al. | |
| 2017/0211574 | A1* | 7/2017 | Loerch ..... | F04C 28/12 |
| 2019/0032655 | A1* | 1/2019 | Mikulic ..... | F04C 28/28 |

FOREIGN PATENT DOCUMENTS

| | | | |
|---|---|---|---|
| JP | H09 317676 | A | 12/1997 |
| WO | WO 93/18307 | A1 | 9/1993 |

* cited by examiner

SCREW COMPRESSOR INCLUDING CONTROL SLIDERS THAT COOPERATE TO FORM AN INFLOW CHAMBER FOR INFLOW FROM A COMPRESSION CHAMBER AND WITH ONE SLIDER PROVIDED WITH AN OUTFLOW OUTLET

CROSS-REFERENCE TO RELATED PATENT APPLICATION

This application is a continuation of International application number PCT/EP2016/057534 filed on Apr. 6, 2016.

This patent application claims the benefit of International application No. PCT/EP2016/057534 of Apr. 6, 2016, the teachings and disclosure of which are hereby incorporated in their entirety by reference thereto.

BACKGROUND OF THE INVENTION

The invention relates to an improvement over existing screw compressors, which existing screw compressors comprise a compressor housing having a screw rotor chamber arranged therein, two screw rotors that are arranged in the screw rotor chamber and are mounted on the compressor housing, each rotatably about a respective screw rotor axis, and engage in each other by means of their helical contours and each cooperate with compression wall surfaces which are adjacent thereto and partly surround them in order to receive gaseous medium that is supplied by way of a low-pressure chamber arranged in the compressor housing and to discharge it in the region of a high-pressure chamber that is arranged in the compressor housing, wherein the gaseous medium is enclosed in compression chambers that are formed between the helical contours and compression wall surfaces that are adjacent thereto with an inflow volume at low pressure and is compressed to a final volume at high pressure, and including two control sliders that are arranged one behind the other in a slider channel of the compressor housing in a direction of displacement parallel to the screw rotor axes and are adjacent to both screw rotors by means of slider compression wall surfaces and are movable in the direction of displacement, wherein a first control slider is arranged such that it affects the final volume and a second control slider is arranged such that it affects the initial volume, wherein, in a combined position with mutually facing end surfaces, the first control slider and the second control slider are sealed tightly with each other and are movable together in the direction of displacement and, in a separated position, are positionable at a spacing from one another, forming an intermediate space.

In these, the problem arises of being able to transfer the control sliders from the combined position to the separated position, starting from different combined positions along the slider channel, as reliably as possible.

SUMMARY OF THE INVENTION

This object is achieved according to the invention with a screw compressor of the kind mentioned in the introduction in that, at least in a transfer position located between the combined position and the separated position, the control sliders form an inflow chamber into which the medium to be compressed flows out of one of the compression chambers by passing between the mutually facing end surfaces of the control sliders, and in that one of the control sliders is provided with at least one outflow outlet that is adjacent to the inflow chamber and through which the medium from the inflow chamber enters an outflow opening in the slider channel that overlaps with the outflow outlet in this transfer position.

The advantage of the solution according to the invention can be seen in particular in the fact that it provides the possibility of obtaining flow conditions that are defined for the medium flowing out of the inflow chamber in the transfer position and which, on the other hand, in turn result in defined pressure conditions in the region of the mutually facing end regions of the control sliders and thus allow a reliable transfer from the combined position of the control sliders to their separated position.

More detailed statements have not yet been made as regards the form taken by the inflow chamber.

Here, an advantageous solution provides for the inflow chamber to extend into a central recess in one of the control sliders.

This provides the possibility on the one hand of enlarging the inflow chamber beyond the intermediate space between the control sliders, and moreover provides the possibility of giving the control slider that is provided with the inflow chamber a smaller mass and thus to make it more responsive.

In principle, the central recess could be provided in the first or in the second control slider.

Because, during the transfer from the combined position to the separated position, the second control slider is typically moved in relation to the first control slider, it is advantageous if the central recess is provided in the second control slider so that the mass thereof can be reduced.

Moreover, it is preferably provided for the at least one outflow outlet to be arranged in the second control slider and thus for the outflow opening, which is provided with the outflow outlet in the transfer position, to be capable of being arranged in the slider channel as close as possible to the low-pressure side.

In this case, it is then also favourably provided for the outflow outlet to open into the central recess in the second control slider.

Further, more detailed statements have not been made as regards the inflow chamber.

Here, it is likewise advantageous if the inflow chamber also extends into an intermediate space that is delimited by the mutually facing end regions of the control sliders and the slider channel.

The position of the outflow opening in the slider channel has not yet been specified in more detail. Here, it is advantageously provided for the slider channel to be provided with at least one lateral outflow opening, that is to say that the outflow opening is not located at the end of the slider channel but in longitudinal sides of the slider channel that run parallel to the direction of displacement.

Moreover, it is preferably provided for the outflow outlet to be arranged in a side wall region of the control slider to which it pertains.

It is particularly favourable if, in the separated position, the outflow opening of the slider channel overlaps at least partly with the intermediate space formed between the end regions of the control sliders such that, in the separated position, the medium does not substantially enter the outflow opening by way of the outflow outlet but can enter the outflow outlet directly from the intermediate space between the control sliders.

As an alternative or in addition to the features described above, the object stated in the introduction is also achieved according to the invention in that the control sliders take a form in their mutually facing end regions such that, during a transfer from the combined position to the separated position, a first throttling gap having a gap width that runs transversely to the direction of displacement is formed in a first transfer position that comes directly after the combined position.

A first throttling gap of this kind provides the possibility of throttling the medium leaving the compression chamber as it enters the intermediate space between the control sliders and thus also in particular the inflow chamber.

It is thus particularly favourable if the first throttling gap is arranged offset in the direction of displacement in relation to the mutually facing end surfaces of the control sliders; this provides the possibility of the throttling gap being formed independently of the gap formed between the end surfaces.

Further, it is particularly advantageous if in the first transfer position the first throttling gap has a smaller gap width than the gap formed between the end surfaces of the control sliders, with the result that the outflow of medium is definable solely by the throttling gap and thus the possibility is provided of producing flow conditions for the outflowing medium that are defined in the first transfer position.

Preferably here, it is further provided for the gap width of the first throttling gap to be present over a distance in the direction of displacement that is greater than the gap width of the throttling gap, with the result that the first transfer position is implementable over a sizeable defined length in the direction of displacement.

Here, the first throttling gap may take the most diverse forms.

Here, an advantageous solution provides for the first throttling gap to be delimited by two wall surfaces, of which the one is arranged in the end region of the first control slider and the other in the end region of the second control slider.

Preferably here, the wall surfaces are located such that the wall surface that is formed by the end region of the first control slider extends adjacent to the end surface of the first control slider.

Further, it is preferably provided for the wall surface that is arranged in the end region of the second control slider to extend adjacent to the end surface of the second control slider.

More detailed statements have not yet been made as regards the alignment of the wall surfaces.

Here, an advantageous solution provides for at least one of the wall surfaces to extend substantially parallel to the direction of displacement.

The term "extending substantially parallel to the direction of displacement" should be understood here to mean that the deviation from a parallel extent is at most ±20°.

Preferably, it is provided for both wall surfaces to extend substantially parallel to the direction of displacement, with the result that the gap width does not vary in the event of movement in the direction of displacement in the first transfer position.

A further advantageous solution provides for the control sliders to take a form in their mutually facing end regions such that, in a second transfer position located between the first transfer position and the separated position, a second throttling gap having a gap width that runs transversely to the direction of displacement and is greater than the gap width of the first throttling gap is formed.

This produces the possibility of moving, after the first transfer position, to a second transfer position in which there are likewise defined conditions for the medium flowing out of the compression chamber and into the intermediate space between the control sliders and thus also in particular entering the inflow chamber.

Preferably here, the second throttling gap is arranged such that it is delimited by at least one wall surface that is arranged on a side of the wall surface delimiting the first throttling gap that is remote from the end surface.

Preferably, this wall surface is set back from the wall surface of this control body that delimits the first throttling gap, in order to achieve a greater gap width.

Further, it is preferably provided for the second throttling gap to be delimited by a wall surface that also delimits the first throttling gap.

Moreover, as an alternative or in addition to the embodiments described above, a further advantageous embodiment provides for at least one of the end surfaces of the control sliders to have a sealing edge surface that is adjacent to the slider compression wall surfaces and, on an opposite side of the sealing edge surface to the slider compression wall surfaces, an inner surface that is adjacent to the sealing edge surface and is set back or recessed in relation thereto in a direction parallel to the direction of displacement.

This solution has the advantage that on the one hand the sealing edge surface of the one end surface can, in the combined position, seal tightly against the other end surface, but on the other the set back or recessed inner surface is available for developing a force that contributes to moving the control sliders apart.

In order to achieve sufficient sealing, it is provided here for the sealing edge surface to extend far enough in the direction of the slider channel for it still to be adjacent to a partial surface of the guide peripheral surface of the respective control slider, with the result that reliable sealing by the sealing edge surface with the opposing end surface of the other control slider is ensured.

Further, in the combined position of the control sliders, it is preferably provided for the inner surface that is set back from the sealing edge surface to form with the opposing end surface a gap space that is connected to an inflow chamber delimited by the control sliders in the combined position and is at the same level of pressure as the inflow chamber, with the result that this can generate a force that is already effective in the combined position and assists in moving the control sliders apart.

Preferably here, it is provided for the inflow chamber to be at low pressure in the combined position of the control sliders.

This is achieved in particular in that, in the combined position of the control sliders, the inflow chamber is connected to the low-pressure chamber of the compressor housing in that, in the combined position, an outflow outlet in one of the control sliders is arranged to overlap with the outflow outlet in the slider channel.

Further features and advantages of the invention form the subject matter of the description below and the representation in the drawing of some exemplary embodiments.

DETAILED DESCRIPTION OF THE INVENTION

Figure 1:
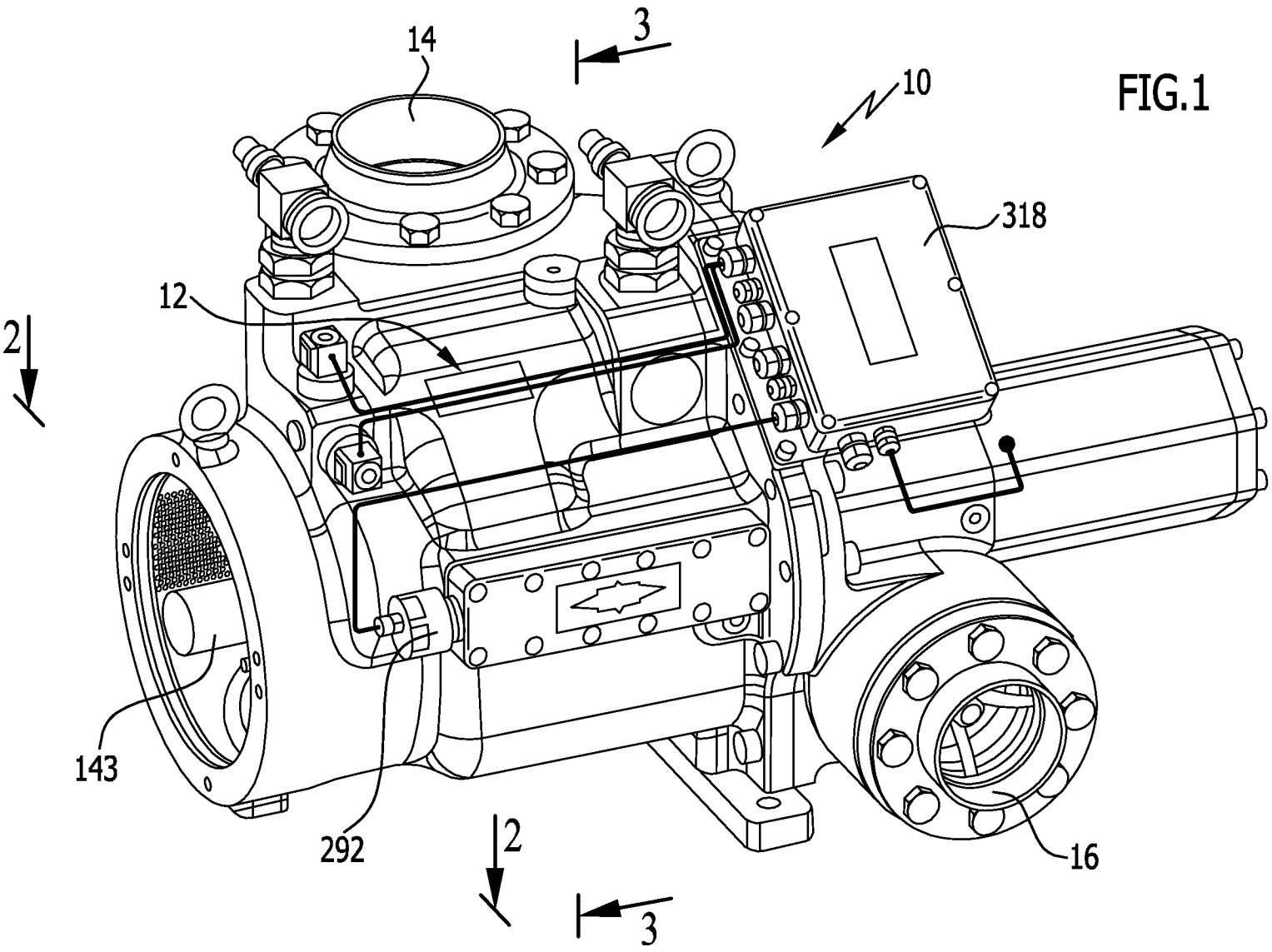
FIG. 1 shows a perspective view of a first exemplary embodiment of a screw compressor according to the invention.

An exemplary embodiment, illustrated in FIG. 1, of a screw compressor 10 according to the invention includes a compressor housing that is designated 12 as a whole and that has an intake connector 14 through which a gaseous medium to be drawn in, in particular refrigerant, is drawn in and a pressure connector 16 through which the gaseous medium that has been compressed to high pressure, in particular refrigerant, is discharged.

Figure 2:
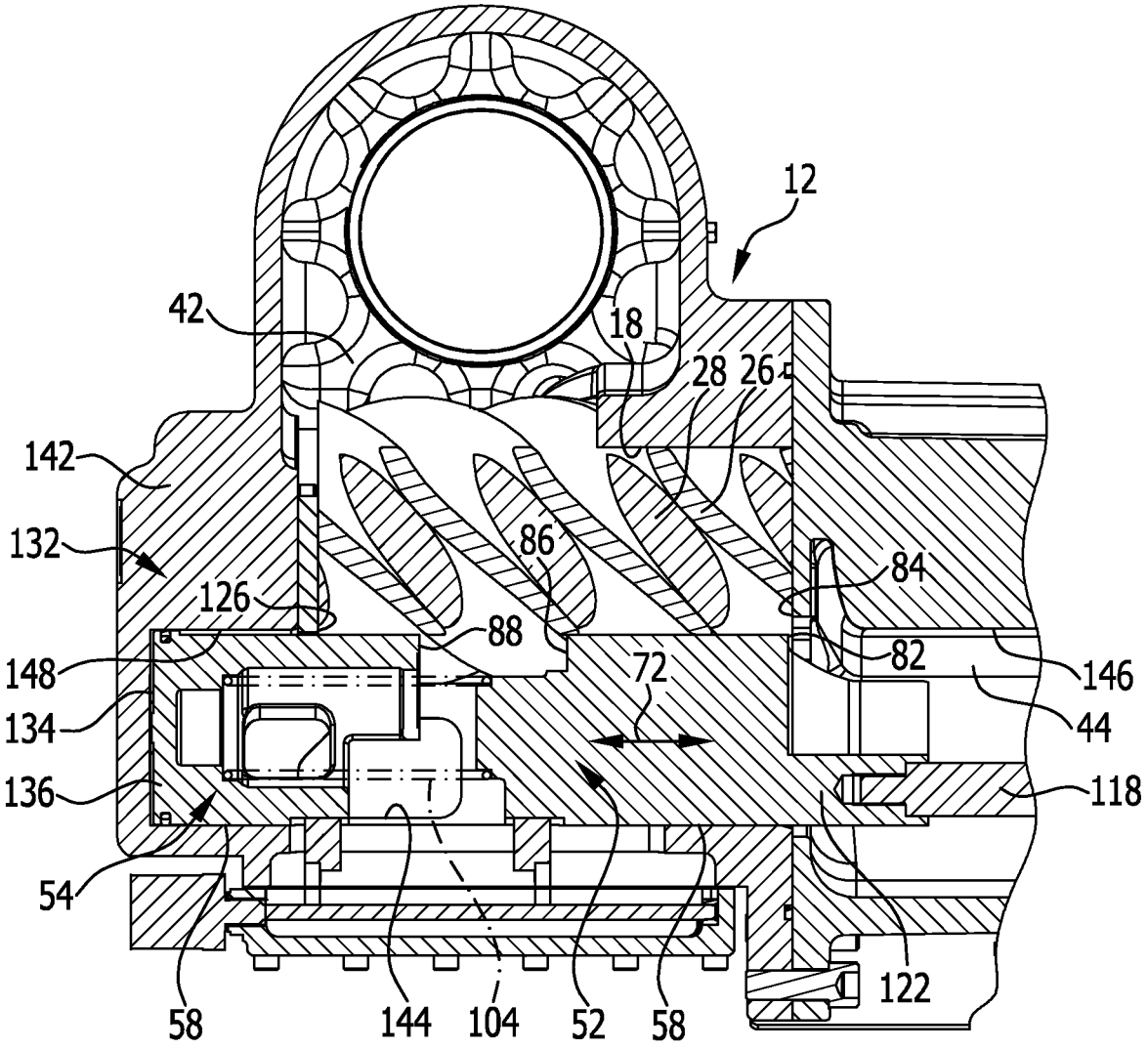
FIG. 2 shows a section along the line 2-2 in FIG. 1.
Figure 3:
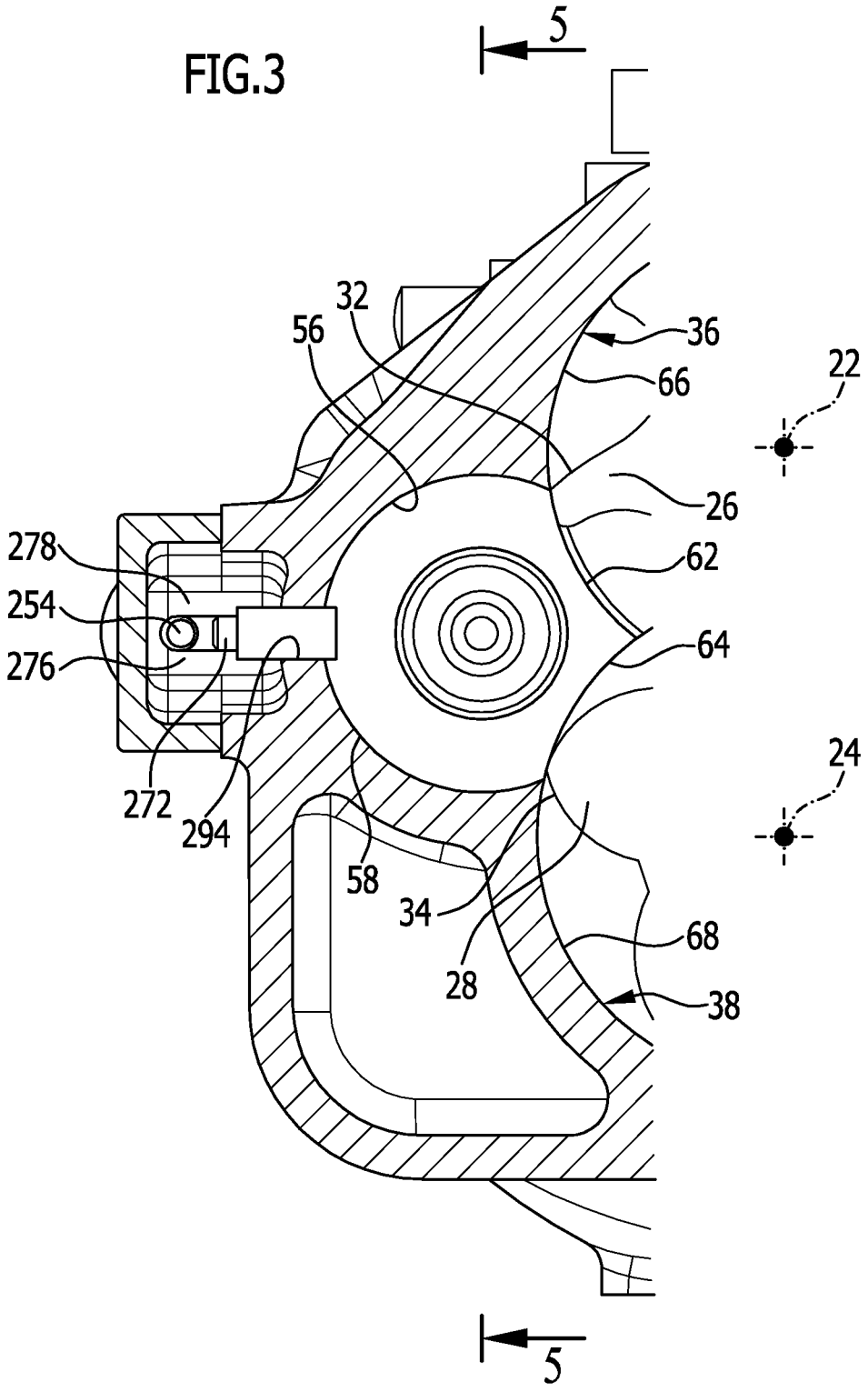
FIG. 3 shows a section along the line 3-3, in the region of a position determining device.

As illustrated in FIGS. 2 and 3, provided in a screw rotor chamber 18 of the compressor housing 12 are two screw rotors 26, 28 that are each rotatable about a respective screw rotor axis 22, 24 and engage in one another by means of their helical contours 32 and 34 and cooperate with compression wall surfaces 36 and 38 respectively of the screw rotor chamber 18 which are peripherally adjacent to the helical contours 32, 34, in order to receive gaseous medium that is supplied to a low-pressure chamber 42 adjacent to the helical contours 32, 34 on the intake side, to compress it and to discharge it at high pressure into a high-pressure chamber 44 in the compressor housing 12.

Here, the gaseous medium, in particular refrigerant, is enclosed in compression chambers, which are formed between the helical contours 32, 34 and the compression wall surfaces 36, 38 that are adjacent to the latter, with an intake volume at low pressure and is compressed to a final volume at high pressure.

For the purpose of adapting the screw compressor 10, for example to the operating conditions required in a refrigerant circuit, the operating state of the screw compressor 10 is adapted on the one hand in respect of the volume ratio, which is the relationship between the maximum enclosed intake volume and the expelled final volume, and on the other in respect of the compressor output, which is the proportion of the volumetric flow that is actually compressed by the screw compressor in relation to the maximum volumetric flow that is compressible by the screw compressor 10.

For the purpose of adapting the operating state, in a first exemplary embodiment that is illustrated in FIG. 2 to FIG. 8, a first control slider 52 and a second control slider 54 are arranged one behind the other in a slider channel 56 that is provided in the compressor housing 12, wherein the slider channel 56 extends parallel to the screw rotor axes 22, 24 and guides the first control slider 52 and the second control slider 54, in the region of their guide peripheral surface 58 that is not adjacent to the screw rotors 26, 28, in a direction of displacement 72 defined by the slider channel 56.

The first control slider 52 faces the high-pressure chamber 44 and is thus arranged on the high-pressure side, and the second control slider 54 is arranged on the low-pressure side in relation to the first control slider 52.

Each of the two control sliders 52 and 54 further has a slider compression wall surface 62 adjacent to the screw rotor 26, and a slider compression wall surface 64 adjacent to the screw rotor 28, which form partial surfaces of the compression wall surfaces 36 and 38, and housing compression wall surfaces 66 and 68 formed by the compressor housing 12, which likewise represent partial surfaces of the compression wall surfaces 36 and 38, supplement the compression wall surfaces 36 and 38, which together with the helical contours 32 and 34 contribute to forming the compression chambers.

As illustrated in FIGS. 2 to 15, the first control slider 52 and the second control slider 54 take a form such that, to the extent that they form the slider compression wall surfaces 62 and 64 and the guide peripheral surface 58, they are identical and can thus be guided displaceably, in a single direction of displacement 72 parallel to the screw rotor axes 22, 24, within the slider channel 56 of the compressor housing 12.

Here, the first control slider 52 forms an outlet edge 82, which faces the high-pressure chamber 44, establishes the final volume of the compression chambers, is displaceable by displacing the first control slider 52 in the direction of displacement 72 and, as a result of its position in relation to an end surface 84 of the screw rotor chamber 18 on the high-pressure side, sets the final volume of the compression chambers that are formed and thus the volume ratio.

This principle of a slider arrangement is known and described for example in WO 93/18307, to which the reader is referred in respect of the description of the principle of functioning.

Figure 4:
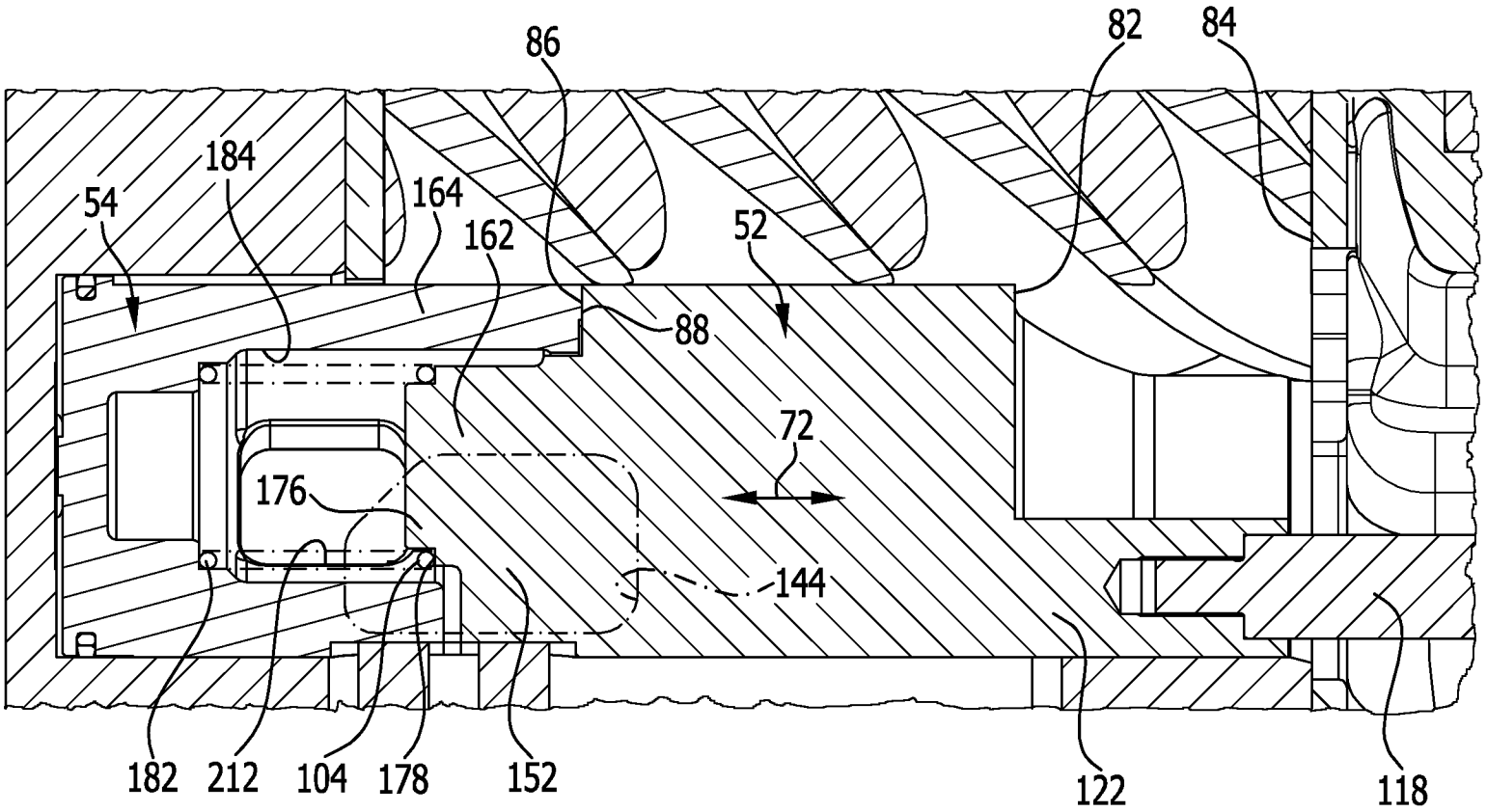
FIG. 4 shows a section similar to FIG. 2 and on a larger scale, in the region of the control sliders, with the maximum output and the minimum volume ratio.

As illustrated in FIGS. 2 and 4 to 15, the first control slider 52 and the second control slider 54 have mutually facing end surfaces 86 and 88 respectively that are adjacent to the slider compression wall surfaces 62, 64 (FIG. 3) and extend transversely thereto, by means of which they are configured to abut against one another, as illustrated for example in FIG. 4, such that the slider compression wall surfaces 62 and 64 (which can be seen further with additional reference of FIG. 3) of the first control slider 52 and the second control slider 54 merge into one another.

Further, a pressure spring 104 is preferably provided that serves to urge the first control slider 52 in relation to the second control slider 54 such that the end surfaces 86 and 88 are movable away from one another.

Figure 5:
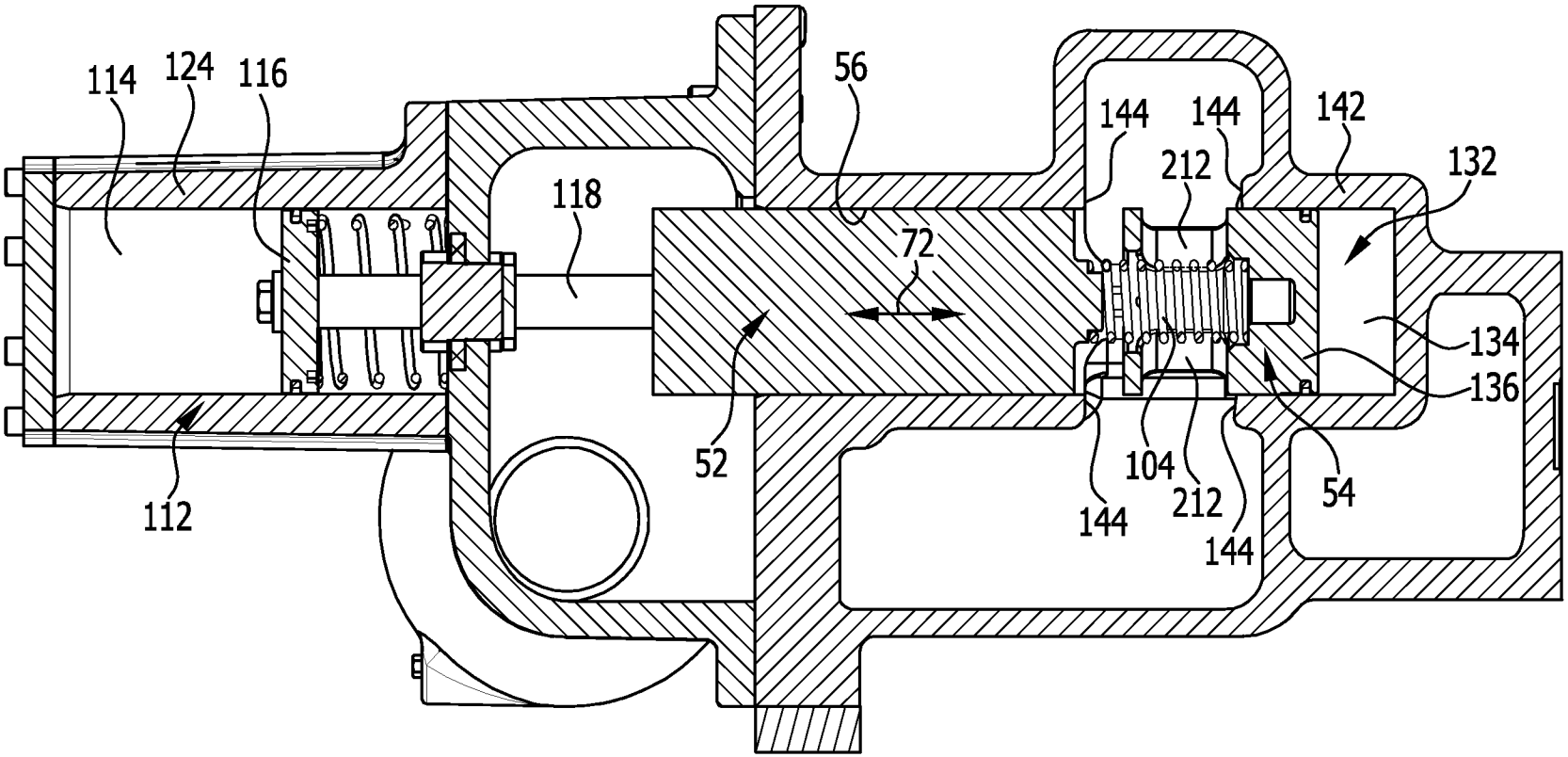
FIG. 5 shows a section along the line 5-5 in FIG. 3.

For the purpose of displacing the first control slider 52 there is provided, as illustrated in FIG. 5, a cylinder arrangement 112 that includes a cylinder chamber 114 and a piston 116, wherein the piston 116 is connected to a piston rod 118 that makes a connection with the first control slider 52, for example with an extension 122 of the first control slider 52, illustrated in FIG. 2 and FIG. 4, that is arranged for example on an opposite side thereof to the end surface 86.

Further, the cylinder arrangement 112 is located in particular on an opposite side of the first control slider 52 to the second control slider 54, preferably in a housing portion 124 of the compressor housing 12 that is on the high-pressure side and is arranged to succeed the slider channel 56 and to succeed the high-pressure chamber 44 and thus on an opposite side of the compressor housing 12 to the low-pressure chamber 42.

The second control slider 54 is displaceable by a cylinder arrangement 132 that includes a piston 136 which is movable in a cylinder chamber 134, wherein the cylinder chamber 134 extends in particular, as an extension of the slider channel 56, in a housing portion 142 that is on the low-pressure side and in which there are arranged bearing units for example also on the drive side for the screw rotors 26 and 28, which are for example drivable by way of a drive shaft 143.

In particular, the piston 136 is integrally formed in one piece with the second control slider 54 and has a piston surface that corresponds at least to the cross sectional surface area of the second control slider 54.

The housing portion 142 on the low-pressure side, which receives the cylinder chamber 134 for the cylinder arrangement 132 for moving the second control slider 54, is located in a region of the compressor housing 12 that is arranged opposite the housing portion 124 on the high-pressure side, for receiving the cylinder chamber 114 for the cylinder arrangement 112.

Figure 6:
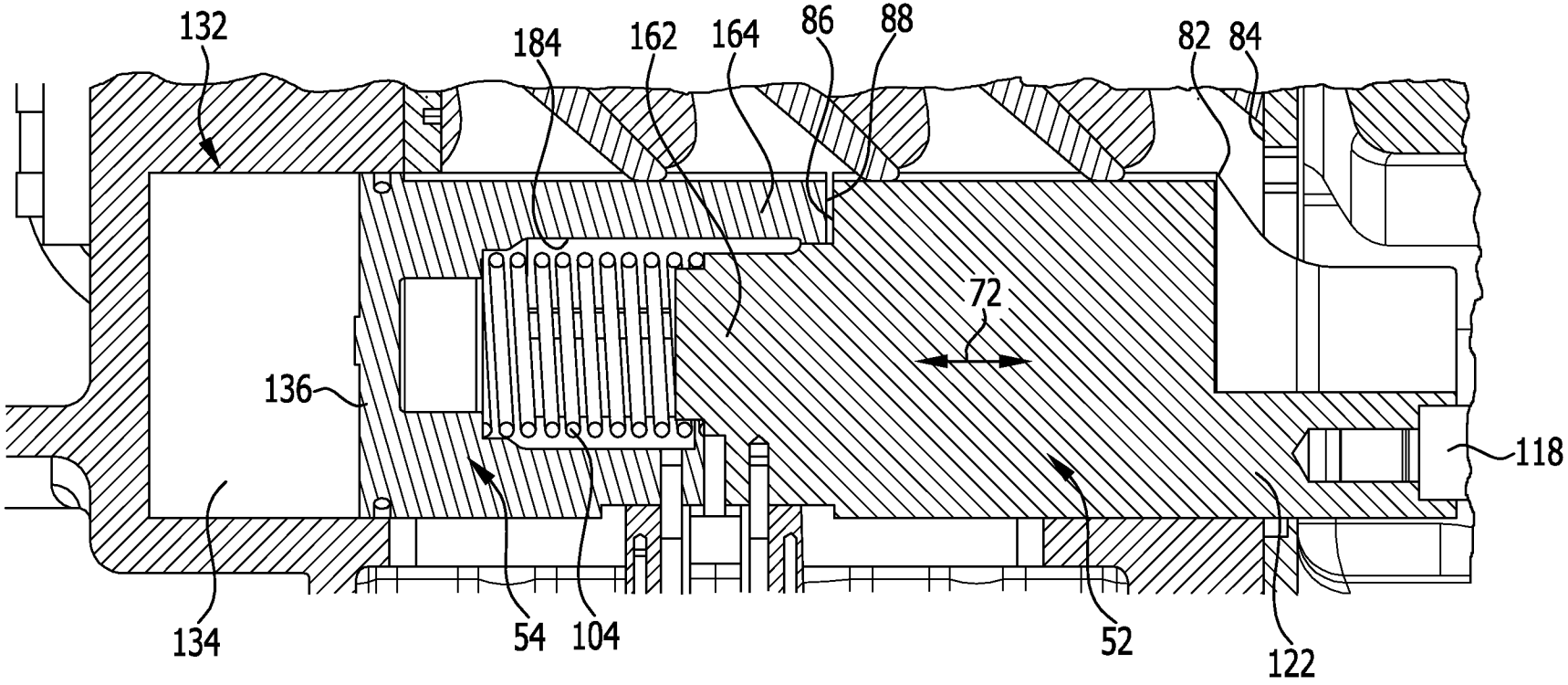
FIG. 6 shows an illustration similar to FIG. 4, with the maximum conveying volume and the maximum volume ratio.

The first control slider 52 and the second control slider 54 can be pushed so far together by the cylinder arrangements 112 and 132 that the end surfaces 86 and 88 abut against one another in a combined position, and the two control sliders 52, 54 can also move together in the combined position, in the manner of a single control slider that extends from the end surface 126 on the intake side in the direction of the end surface 84 on the pressure side, and whereof the outlet edge 82 contributes to establishing the volume ratio, with the screw compressor 10 always conveying the maximum volumetric flow in this combined position, as illustrated in FIG. 4 and FIG. 6.

The volume ratio can be adjusted in dependence on the position of the outlet edge 82 in relation to the end surface 84, increasing from the minimum value applying in the position according to FIG. 4 as the spacing from the outlet edge 82 to the end surface 84 decreases, and reaches its maximum value when the outlet edge 82 has the least spacing from the end surface 84 that is required for minimising the final volume, as illustrated for example in FIG. 6.

If the compressor output, that is to say the volumetric flow that is actually conveyed, is additionally to vary, then as illustrated for example in FIG. 7 to FIG. 15 the end surfaces 86 and 88 are separated by moving the control sliders 52 and 54 apart, into a separated position, in particular by moving the second control slider 54 in the direction of the housing portion 142 on the low-pressure side.

In the separated position, the second control slider 54 is ineffective, since the medium to be compressed flows out of the compression chamber above the end surfaces 86 and 88, between the control sliders 52, 54 in the direction of the slider channel 56, which is connected to the low-pressure chamber 42 by way of outflow openings 144 arranged laterally on the slider channel 56 in the compressor housing 12 (FIG. 2) and channels that are adjacent to these outflow openings 144 in the compressor housing 12.

Preferably, outflow openings 144 are arranged opposite one another on mutually opposing longitudinal sides of the slider channel 56.

The outflow openings 144 in particular extend over a region of the slider channel 12 that extends from the end surface 126 on the intake side in the direction of the end surface 84 on the pressure side.

In this way, the position of the end surface 86 of the first control slider 52 establishes the initial volume in the separated position.

Provided the outlet edge 82 is not in a position in which it predetermines the minimum possible final volume, however, the relationship between the initial volume, predetermined by the end surface 86, and the final volume, predetermined by the outlet edge 82, is not variable.

Figure 15:
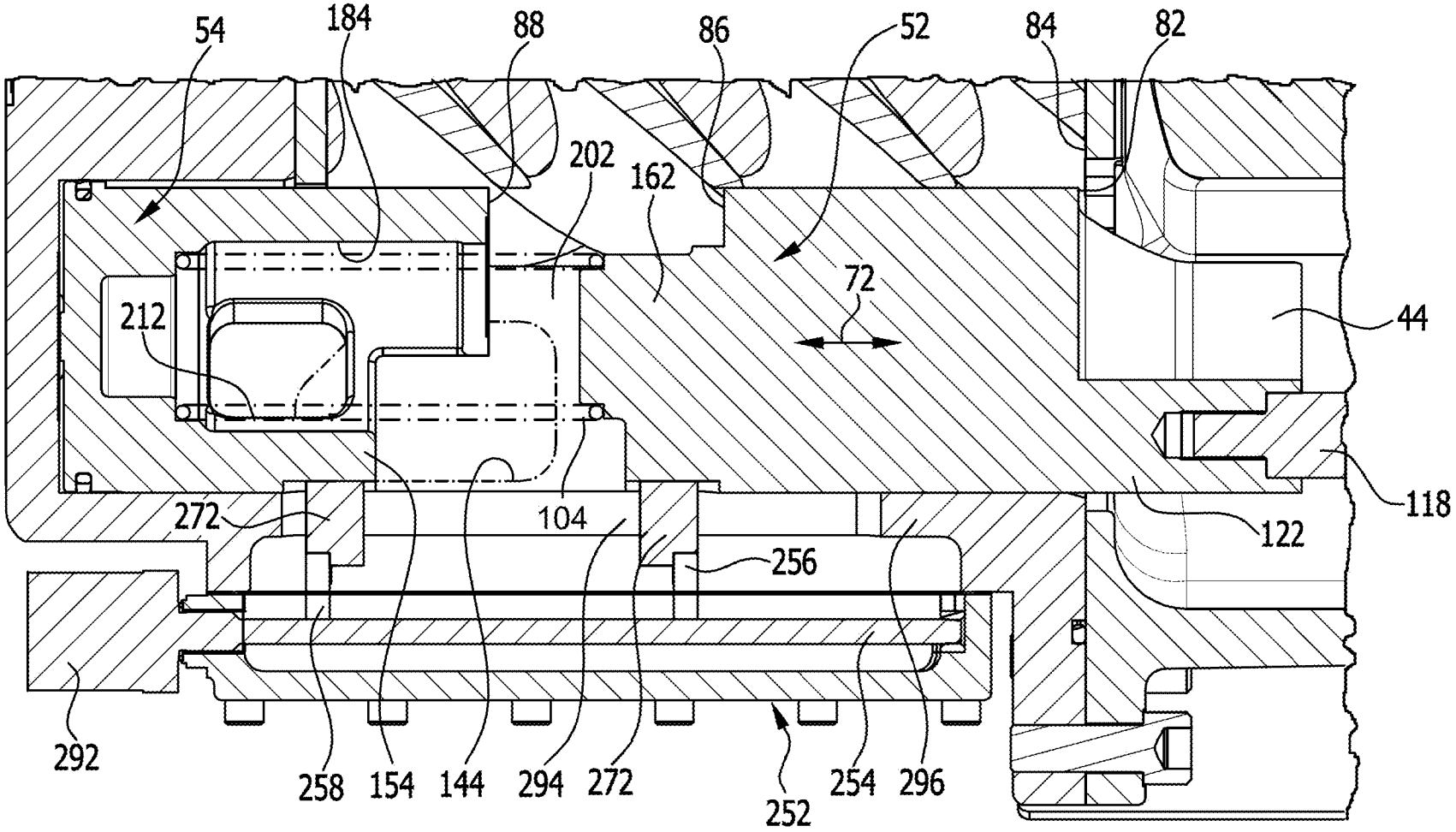
FIG. 15 shows an illustration of the control sliders with a position determining device similar to FIG. 4, in a separated position.

If, however, as illustrated in FIG. 15, the first control slider 52 is displaced far enough in the direction of the high-pressure chamber 44 for the outlet edge 82 to have the minimum spacing from the end surface 84 or even to be displaced beyond this into a retraction chamber 146, which is surrounded by the high-pressure chamber 44, for the first control slider 52, it is possible to vary the initial volume 86 without changing the final volume, since the latter then continues to remain at a minimum.

In order to eliminate the action of the second control slider 54 in the separated position, it is retracted into the housing portion 142 in particular by means of the cylinder arrangement 132, wherein the cylinder chamber 134 is dimensioned such that at the same time it includes a retraction chamber 148 for the second control slider 54 and thus provides the possibility of moving the second control slider 54 far enough away from the first control slider 52 for the end surface 88 no longer to affect the initial volume.

Thus, the second control slider 54 enables the initial volume to be affected either in that it abuts by means of its end surface 88 against the end surface 86 of the first control slider 52, for forming the combined position of the control sliders 52, 54, and thus maximises the initial volume, or it can be moved by means of its own end surface 88 far enough away from the end surface 86 of the first control slider 52 for there to be no further effect of any kind on the initial volume by the second control slider 54.

Figure 7:
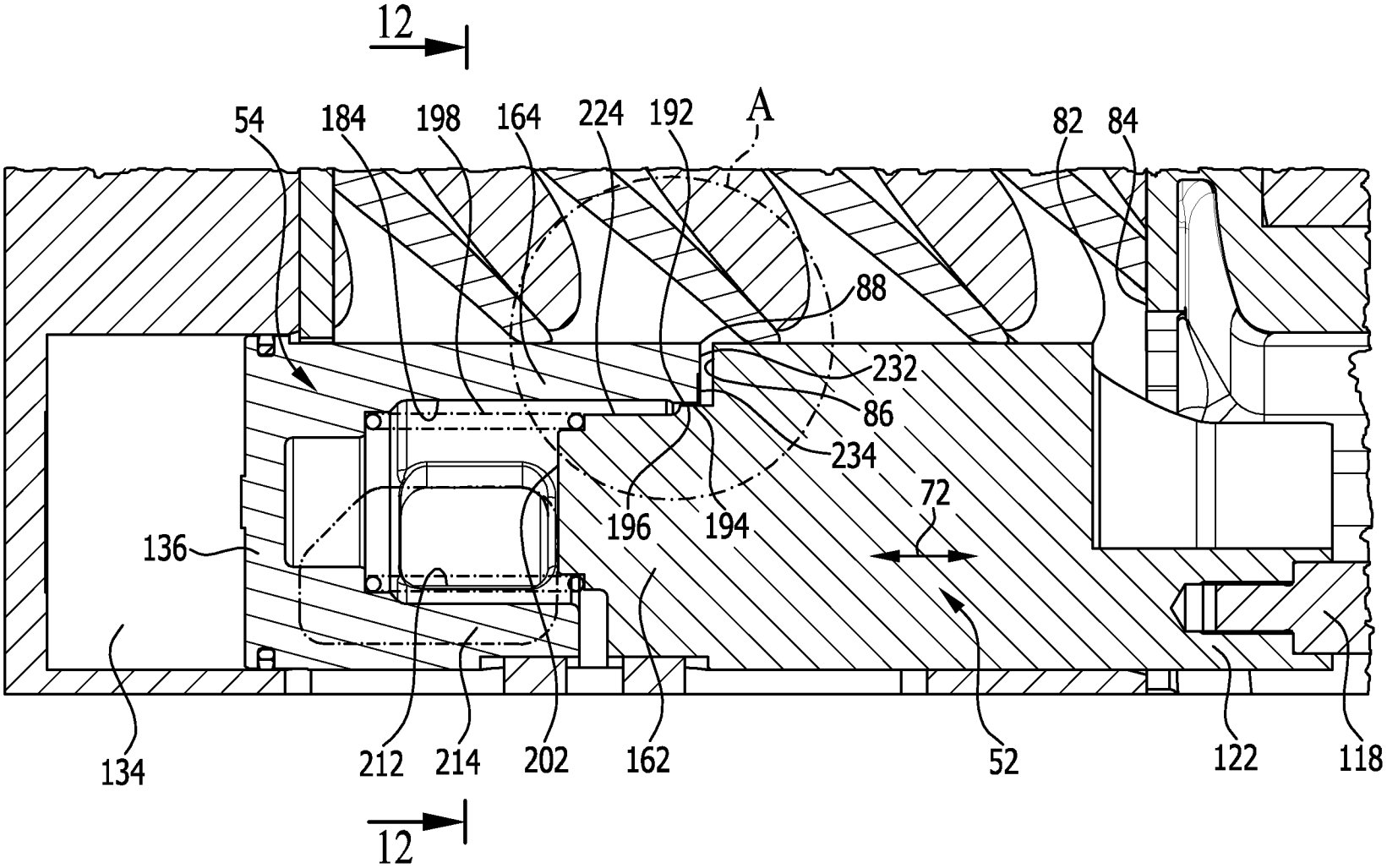
FIG. 7 shows an illustration similar to FIG. 4, in a first transfer position.
Figure 8:
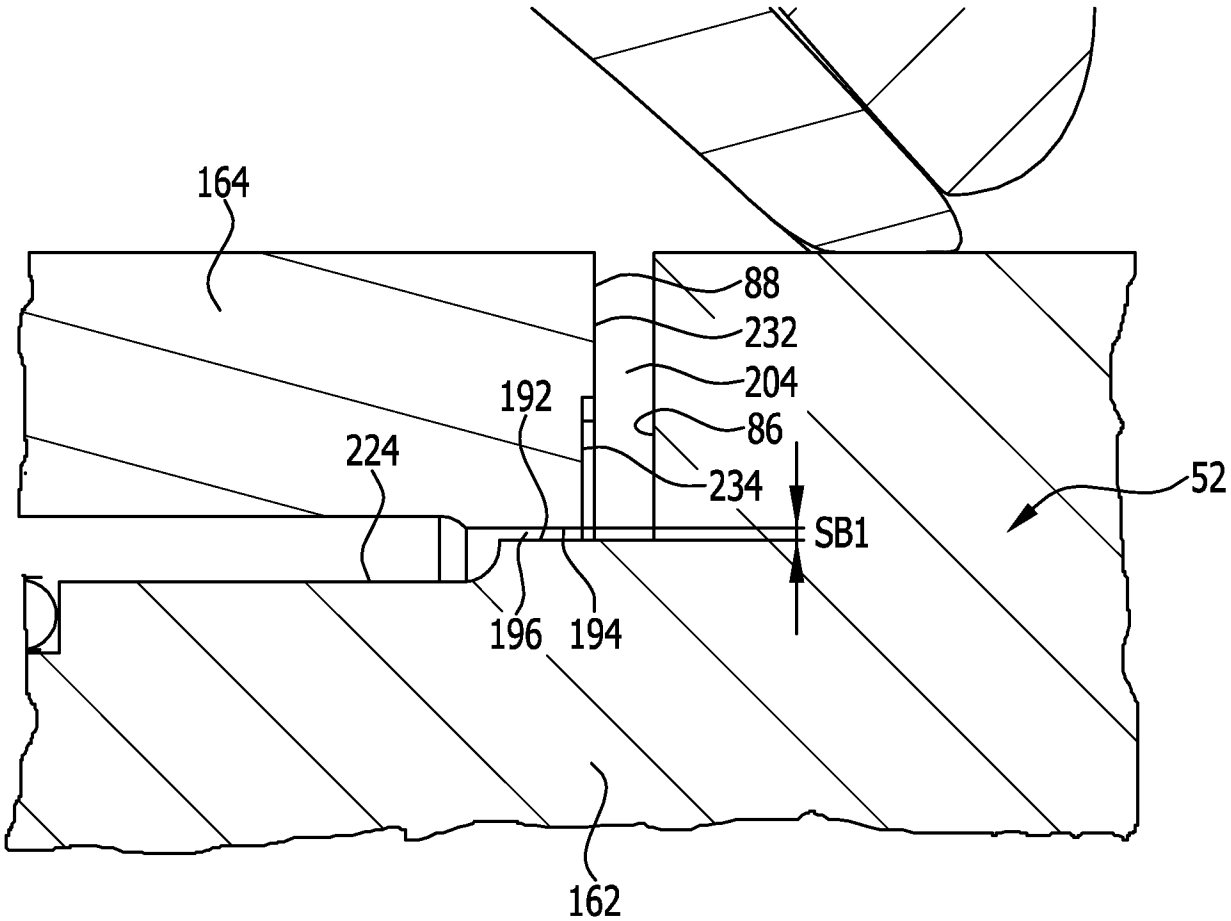
FIG. 8 shows an illustration, on a larger scale, of a region A in FIG. 7.
Figure 9:
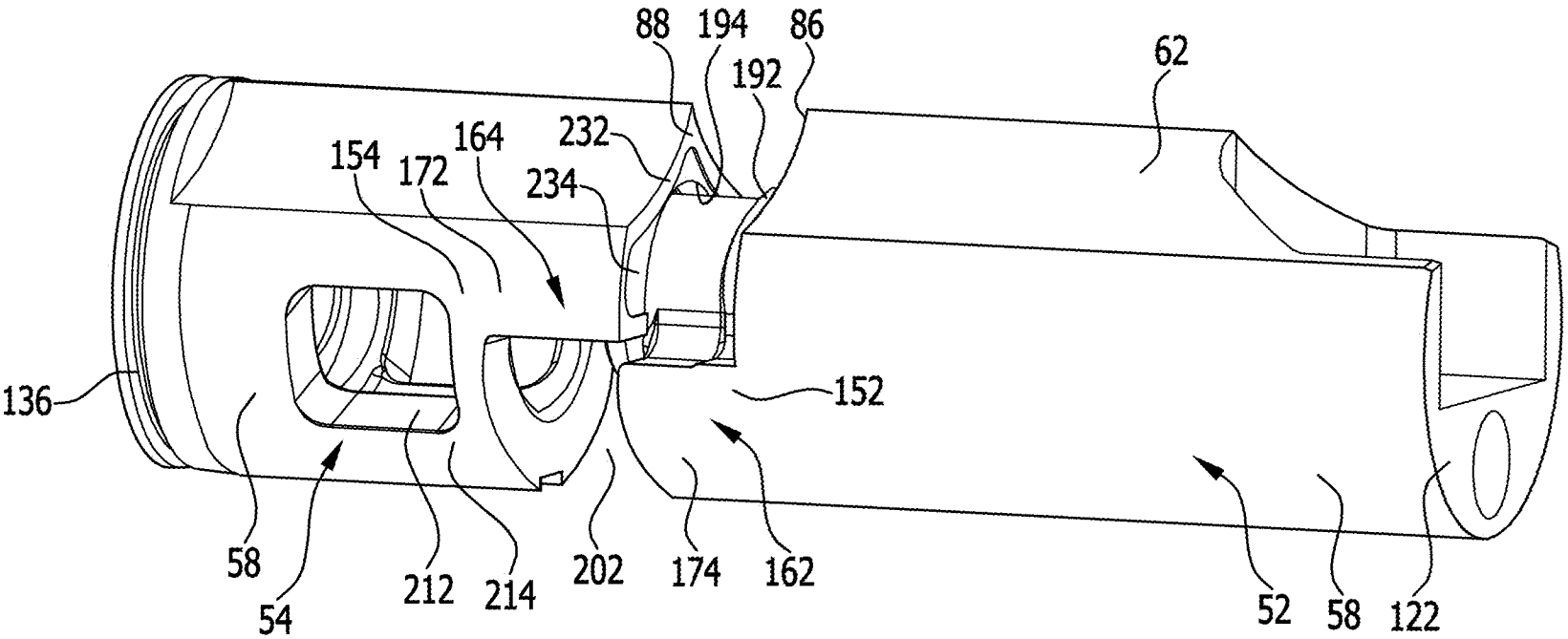
FIG. 9 shows a perspective illustration of the first and the second control slider.
Figure 10:
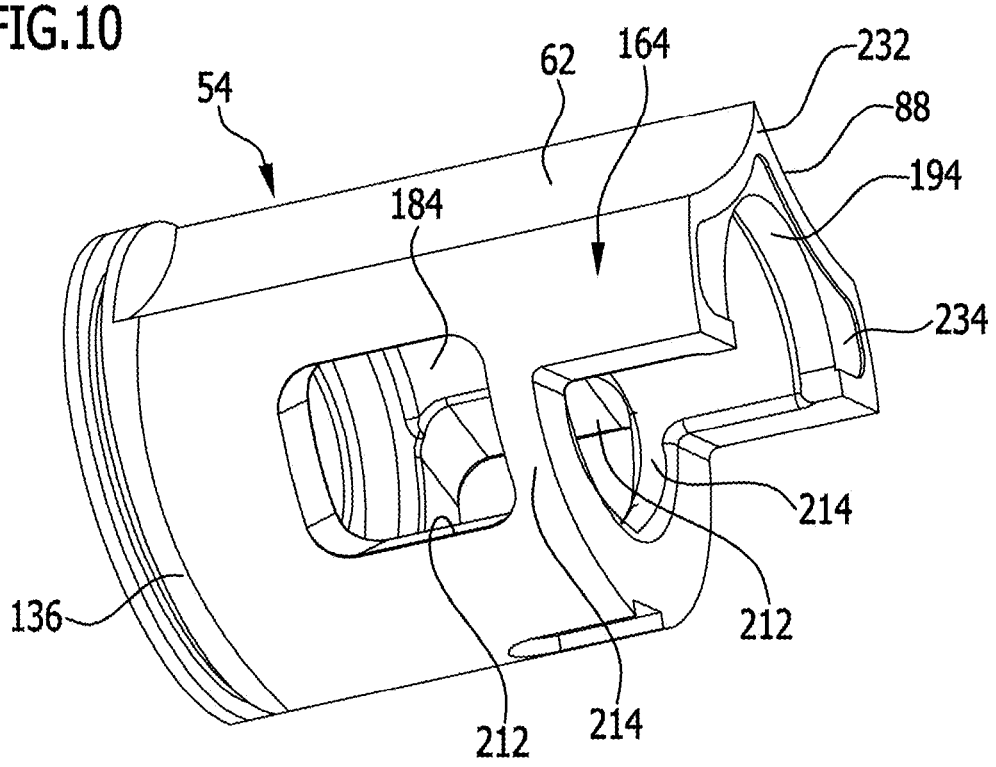
FIG. 10 shows a perspective illustration of the second control slider.
Figure 11:
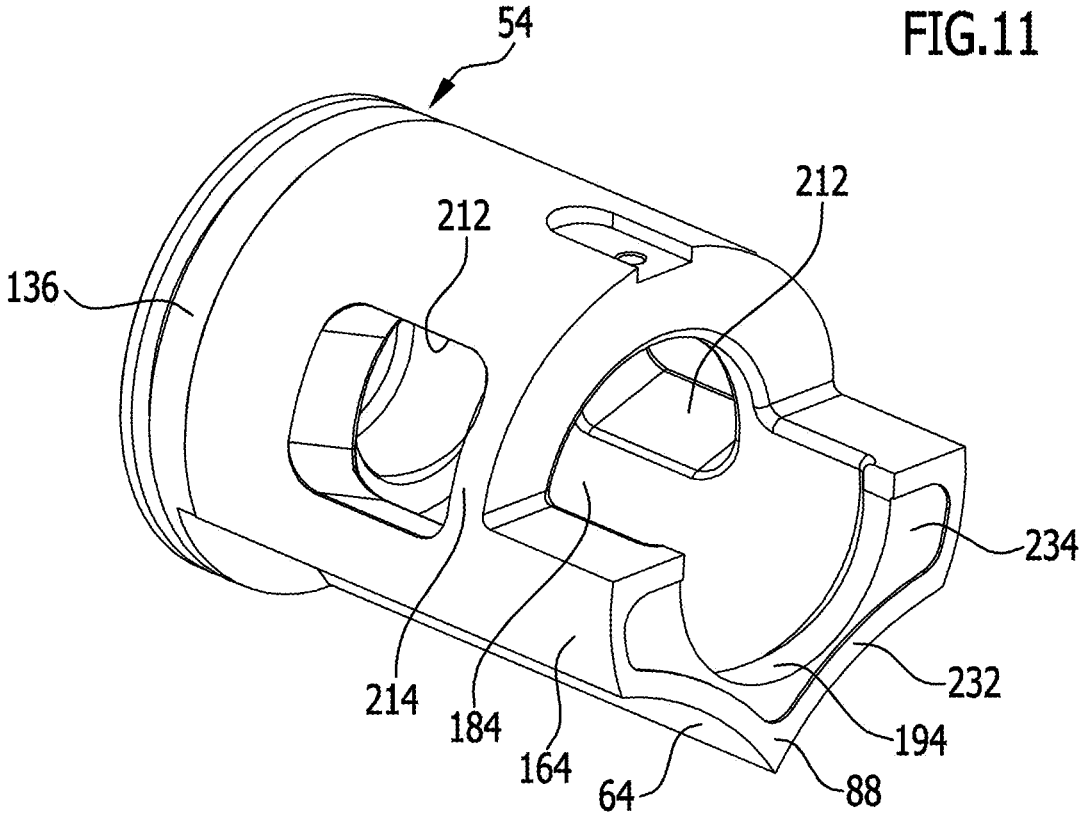
FIG. 11 shows a perspective illustration, turned in relation to FIG. 10, of the second control slider.

As illustrated in FIGS. 2, 4, 6 to 8 and in perspective in FIGS. 9 to 11, the control sliders 52, 54 take a stepped form in their mutually facing end regions 152, 154, wherein the second control slider 54 has an extension 164 that carries the slider compression wall surfaces 62, 64 and the end surface 88, and hence is adjacent to the helical contours 32, 34, while the first control slider 52 has an extension 162 that projects beyond the end surface 86 in the direction of the second control slider 54 and is in particular located substantially in the slider channel 56.

The extensions 164 and 162 preferably take a form such that, in the combined position illustrated in FIG. 4 and FIG. 6, the extension 164 is above the extension 162 such that the end surfaces 88 and 86 of the control sliders 54 and 52 respectively abut sealingly against one another, and the slider compression wall surfaces 62, 64 merge into one another.

Further, in particular the extension 164 takes a form such that it moreover includes partial surfaces 172 of the guide peripheral surface 58 of the second control slider 54 that are adjacent to the slider compression wall surfaces 62, 64 and the end surface 68, with the result that the extension 164 is also, for its part, guided in the slider channel 56 (FIG. 9).

Further, the extension 162 for its part moreover forms a partial surface 174 that supplements the partial surfaces 172 in the peripheral direction to form the peripheral surface 58.

The extension 162 further includes a cylindrical portion 176 which, as illustrated for example in FIGS. 4 and 6, forms a receptacle 178 for the pressure spring 104, which extends from this receptacle 178 to a support flange 182 of a central recess 184 provided in the second control slider 54 and acts on the control sliders 52, 54 with a force tending to move the control sliders 52, 54 away from one another.

In a first transfer position that occurs on moving from the combined position to the separated position, the extensions 164, 162—by means of their first wall surfaces 192 and 194, which face one another in the combined position (FIG. 4 and FIG. 6) and extend from the end surfaces 86, 88 approximately parallel to the direction of displacement 72—form a first throttling gap 196 that has a first gap width SB1 running transversely to the direction of displacement 72 and, as illustrated in FIG. 7 and in particular FIG. 8, throttles flow of the medium to be compressed into the inflow chamber 198 that includes the central recess 184 in the second control slider 54 and an intermediate space 202 that is already formed in the first transfer position between the control sliders 52, 54, by moving from the combined position in the direction of the separated position, wherein the intermediate space 202 is delimited transversely to the direction of displacement by the slider channel 56.

This results in an outflow of the medium that is defined by the throttling gap 196, out of the compression chamber located above an intermediate space 204 formed between the end surfaces 86, 88.

In order to permit optimum outflow of the medium from the inflow chamber 198 to the low-pressure chamber 42 in this first transfer position, the second control slider 54 is provided in the region of its side walls 214 forming the guide peripheral surfaces 58 with outflow outlets 212, in particular outflow windows 212, which are arranged in the side walls 214 of the second control slider 54 that delimit the central recess 184 (FIGS. 7, 9 to 11), wherein the outflow outlets 212 are positioned such that they are arranged to overlap with the lateral outflow openings 144 in the first transfer position. In particular, the extent of the intermediate space 202 in the direction of displacement 72 is small enough for it not to overlap or substantially to overlap with the outflow openings 144.

In this way, in the first transfer position the first throttling gap 196 provides the relevant value for throttling the outflowing medium, as a result of the flow paths taking this form.

If there is a transfer from the first transfer position (illustrated in FIG. 7) to a second transfer position (illustrated in FIGS. 13 and 14), the first throttling gap 196 formed between the first wall surfaces 192 and 194 of the extensions 162, 164 is inactive, and a second throttling gap 222 is formed that has a second gap width SB2 running transversely to the direction of displacement 72 and has a larger cross section than the first throttling gap 196, between the wall surface 194 of the extension 164 and a wall surface 224 of the first extension 162 that is set back from the wall surface 192.

In the second transfer position too (FIGS. 13 and 14), the outflow outlets 212 are arranged such that they overlap with the outflow openings 144, with the result that the second throttling gap 222 provides the relevant value for throttling the outflowing medium.

From the second transfer position, there is a transfer to the separated position (FIG. 15), in which the intermediate space 202 extends in the direction of displacement 72 such that the medium can flow directly from the intermediate space 202 through the outflow openings 144 and into the low-pressure chamber 42.

So that at least a partial surface of the end surfaces 86, 88 of the control sliders 52, 54 is moreover already available in the combined position, as surfaces under low pressure that result in forces acting in opposition to the force action of the cylinder arrangements 112 and 132, one of the end surfaces 86, 88—for example the end surface 88 as illustrated in FIGS. 10 and 11—is provided with a sealing edge surface 232 that is adjacent to the slider compression wall surfaces 62, 64 and the partial surface 172 of the guide peripheral surface 58, and an inner surface 234 is set back or recessed relative to the sealing edge surface 232, such that there is produced between this inner surface 234 and the end surface 86 a gap space 236 in which there is medium under low pressure even in the combined position of the control sliders 52, 54, with the result that the inner surface 234 under low pressure and the partial region of the end surface 86 facing it result in the forces acting in opposition to the cylinder arrangements 112 and 132, wherein these forces assist transfer from the combined position to the separated position and thus make it more functionally reliable (FIGS. 9 to 11).

For determining the positions of the first control slider 52 and the second control slider 54, there is provided a position determining device which is designated 292 as a whole and includes a detector element 254 that extends parallel to the direction of displacement 72 of the control sliders 52, 54 and thus parallel to the screw rotor axes 22, 24, and which is able to determine the positions of position indicator elements 256 and 258.

Here, the position indicator element 256 is fixedly coupled to the first control slider 52, in particular to the extension 162 of the first control slider 52, and the position indicator element 258 is coupled to the second control slider 54, in particular to the end region 154 thereof that is located in the slider channel 56 and faces the first control slider 52, as illustrated in particular in FIG. 15.

Figure 12:
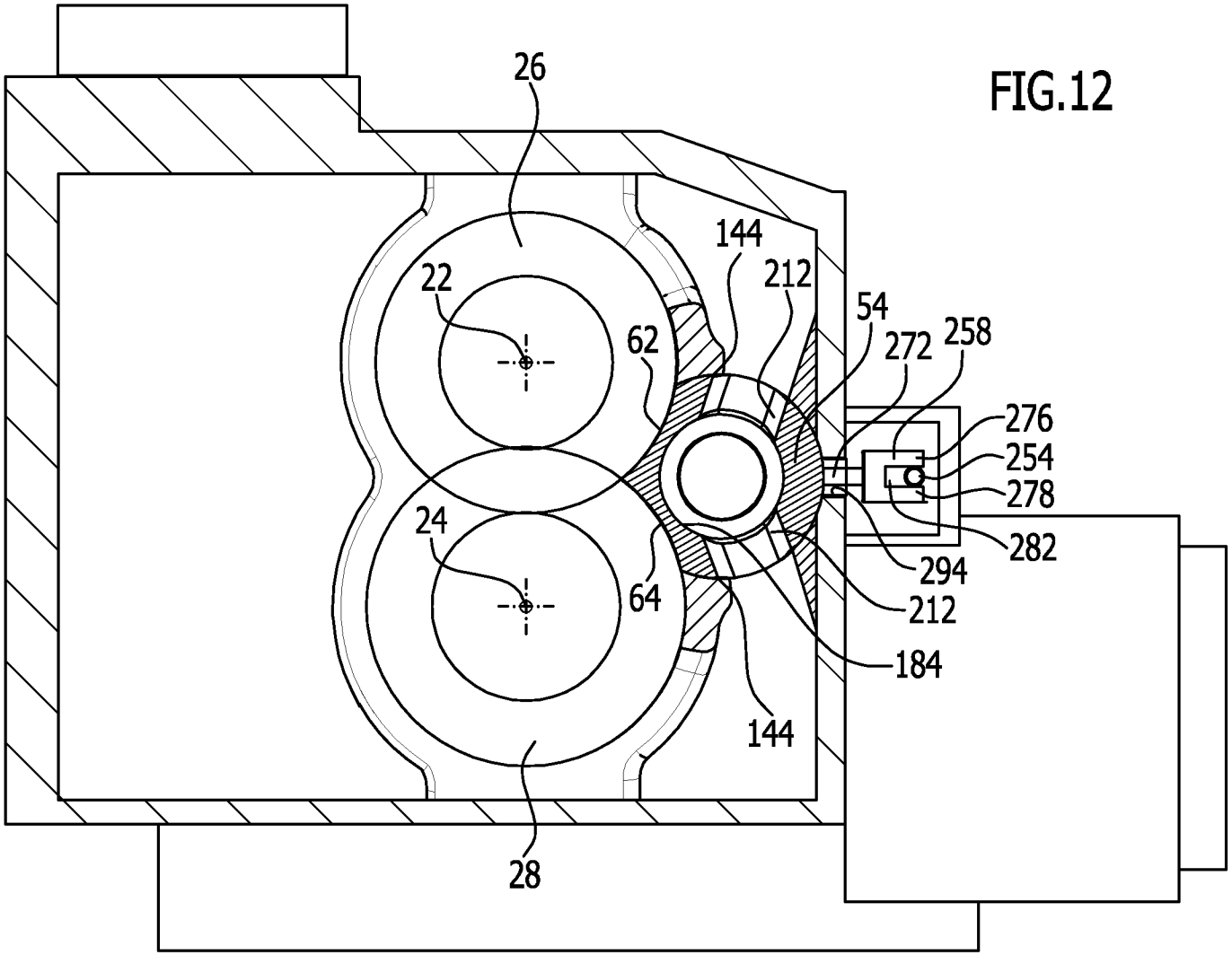
FIG. 12 shows a section along the line 12-12 in FIG. 7.
Figure 13:
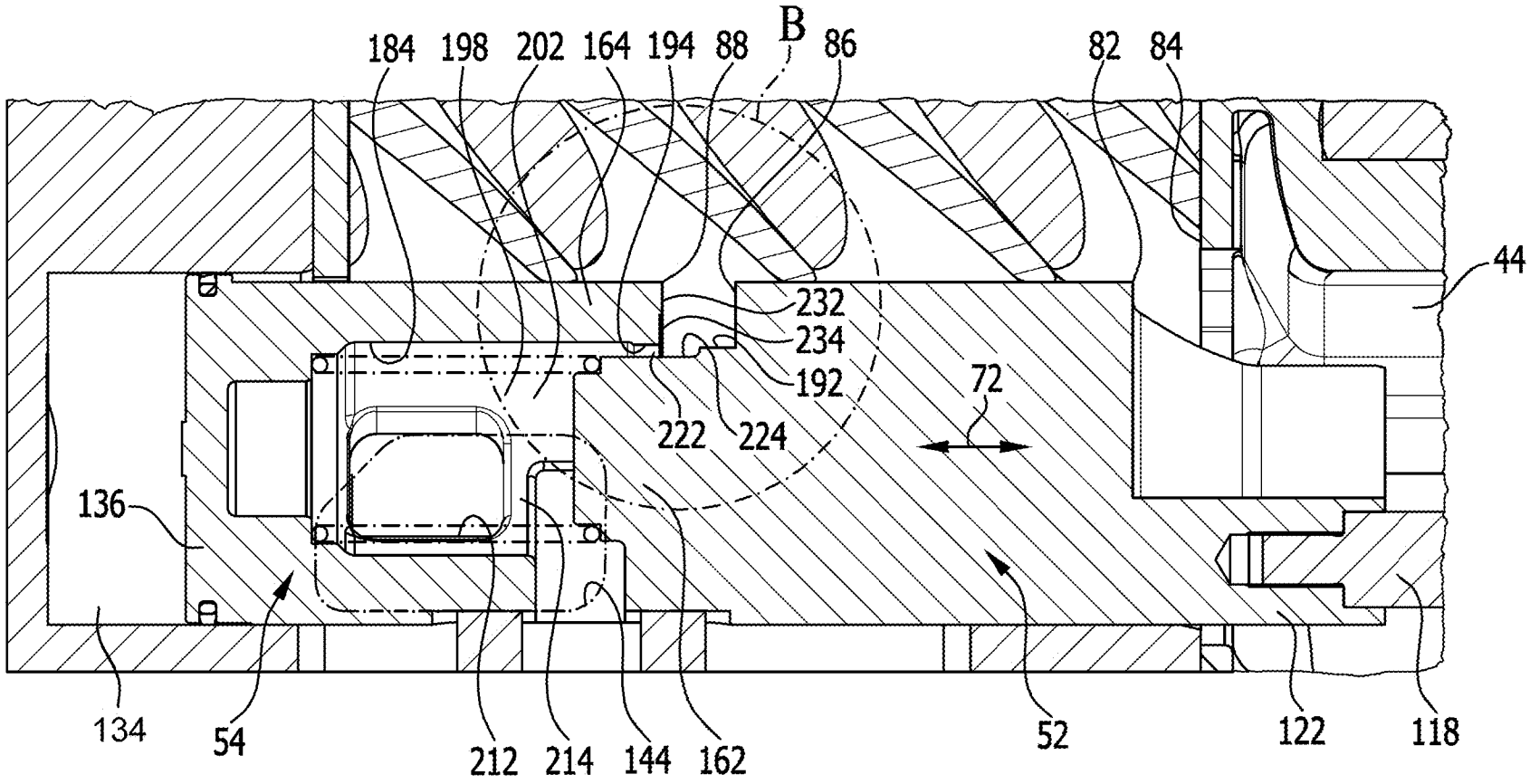
FIG. 13 shows an illustration similar to FIG. 7, in a second transfer position.
Figure 14:
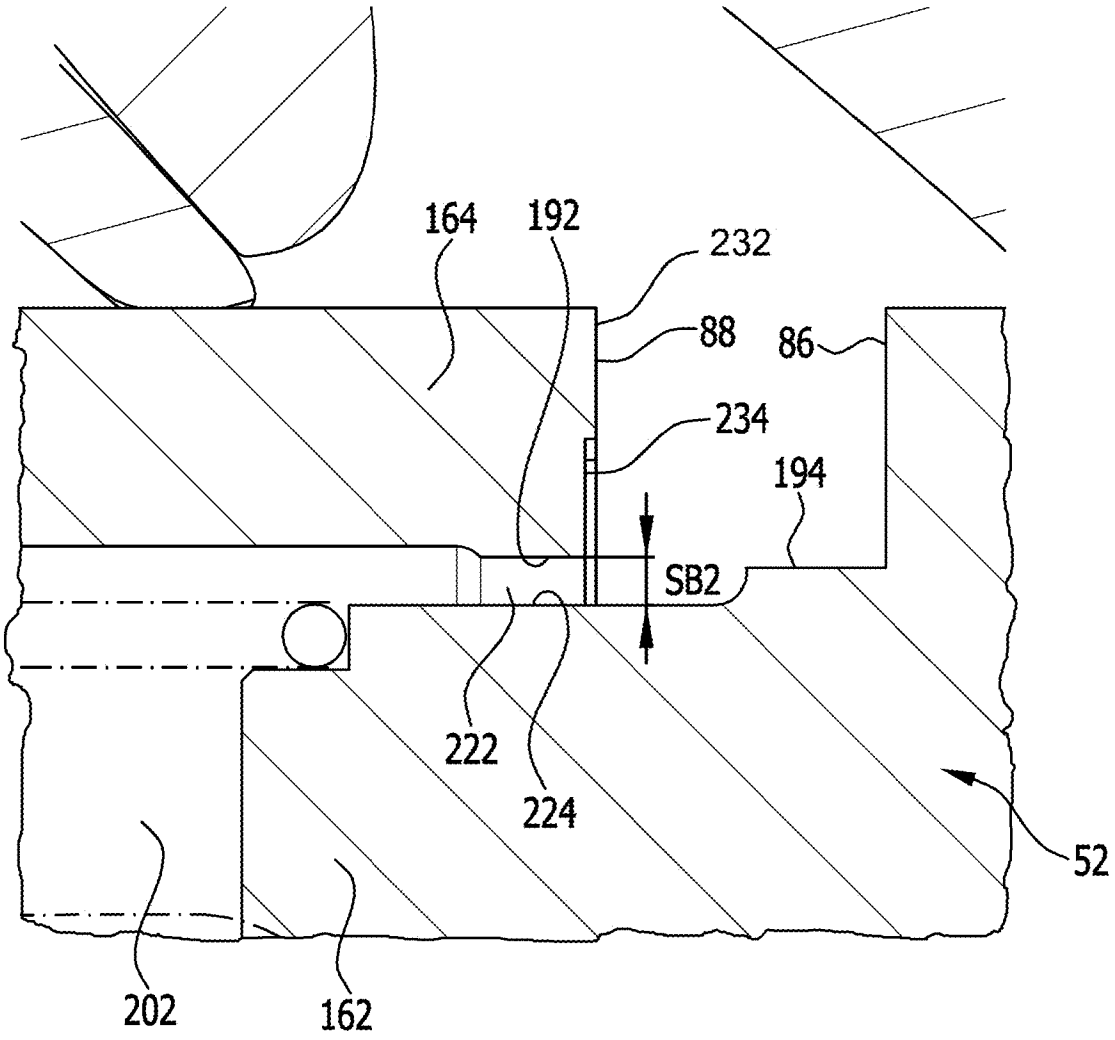
FIG. 14 shows an illustration, on a larger scale, of a region B in FIG. 13.

As illustrated in FIG. 12, each of these position indicator elements 256 and 258 includes a forked element that is designated 274 as a whole and delimits by means of its two fork limbs 276 and 278 an intermediate space 282 that lies between them and through which the elongate detector element 254 extends. Each of these forked elements 274 is coupled to the corresponding control slider 52, 54 by way of a connecting body 272 that is connected to the extension 162 or the end region 154 respectively (FIG. 15).

The connecting bodies 272 that are held on the respective control sliders 52, 54 pass through an elongate, slot-like passage 294 which is made in a housing wall 296 forming the slider channel 56 and which has a length that, in the separated position, allows the second control slider 54 to be retracted entirely into the retraction chamber 148 and the first control slider 52 to be positioned with a minimum initial volume and the first control slider 52 to be positioned with a minimum volume ratio, that is to say with a maximum spacing of the outlet edge 82 from the end surface 84 on the pressure side, and moreover, in the combined position, allows the second control slider 54 to be positioned with the first control slider 52, with maximum volume ratio and minimum volume ratio.

Together with the slot-like passage 294, each connecting body 272 that is connected to the respective control slider 52 or 54 forms an element preventing rotation of the respective control slider 52, 54, similar to guidance through a groove block and a groove, with the result that there is no need to provide grooves in the control sliders 52, 54 to cooperate with groove blocks projecting into the slider channel 56 (FIGS. 12 and 15).

The passage 294 is always kept at the pressure in the low-pressure chamber 42, and thus also serves to keep the control sliders 52, 54 abutting by means of their guide peripheral surface 58 against the slider channel 56, with the result that the control sliders 52, 54 cannot press the slider compression wall surfaces 62, 64 against the screw rotors 26, 28 as a result of the high pressure built up between the slider channel 56 and the guide peripheral surface 58.

Here, sealing of the passage 294 from relatively high pressures, in particular also the high pressure, is brought about by the narrow tolerance of the gap between the slider channel 56 and the guide peripheral surface 58 of the control sliders 52, 54.

For the purpose of moving the control sliders 52 and 54 into the positions provided therefor, as illustrated in FIG. 1 there is provided a controller 318 which, as a result of the connection with the position determining device 292, is able to determine the actual positions of the control sliders 52, 54.

Using the controller 318, the cylinder arrangements 112 and 132 are controllable in order to position the control sliders 52, 54.

The invention claimed is:

1. A screw compressor, comprising:

a compressor housing having a screw rotor chamber arranged therein, two screw rotors that are arranged in the screw rotor chamber and are mounted on the compressor housing, each rotatably about a respective screw rotor axis, and engage in each other by means of their helical contours and each cooperate with compression wall surfaces which are adjacent thereto and partly surround them in order to receive gaseous medium that is supplied by way of a low-pressure chamber arranged in the compressor housing and to discharge the gaseous medium in the region of a high-pressure chamber that is arranged in the compressor housing, wherein the gaseous medium is enclosed in compression chambers that are formed between the helical contours and compression wall surfaces that are adjacent thereto with an inflow volume at low pressure and is compressed to a final volume at high pressure, and two control sliders that are arranged one behind the other in a slider channel of the compressor housing in a direction of displacement parallel to the screw rotor axes and are adjacent to the two screw rotors by means of slider compression wall surfaces and are movable in the direction of displacement, wherein a first control slider of the two control sliders is arranged such that it affects the final volume and a second control slider of the two control sliders is arranged such that it affects the initial volume, wherein, in a combined position with mutually facing end surfaces the first control slider and the second control slider are sealed tightly with each other and are movable together in the direction of displacement and, in a separated position, are positionable at a spacing from one another, forming an intermediate space, wherein at least in a transfer position located between the combined position and the separated position, the two control sliders foim an inflow chamber into which the medium to be compressed flows out of one of the compression chambers by passing between the mutually facing end surfaces of the two control sliders, and one of the two control sliders is provided with at least one outflow outlet that is adjacent to the inflow chamber and through which the medium from the inflow chamber enters an outflow opening in the slider channel that overlaps with the outflow outlet in the transfer position.

2. A screw compressor according to claim 1, wherein the inflow chamber extends into a central recess in one of the two control sliders.

3. A screw compressor according to claim 2, wherein the central recess is provided in the second control slider.

4. A screw compressor according to claim 1, wherein the at least one outflow outlet is arranged in the second control slider.

5. A screw compressor according to claim 4, wherein the outflow outlet opens into the central recess in the second control slider.

6. A screw compressor according to claim 1, wherein the inflow chamber also extends into an intermediate space that is delimited by the mutually facing end regions of the two control sliders and the slider channel.

7. A screw compressor according to claim 1, wherein the slider channel is provided with at least one lateral outflow opening.

8. A screw compressor according to claim 1, wherein the outflow outlet is arranged in a side wall region of the control slider to which it pertains.

9. A screw compressor according to claim 1, wherein, in the separated position, the outflow opening of the slider channel overlaps at least partly with the inteiiiiediate space formed between the end regions of the two control sliders.

10. A screw compressor, comprising:

a compressor housing having a screw rotor chamber arranged therein, two screw rotors that are arranged in the screw rotor chamber and are mounted on the compressor housing, each rotatably about a respective screw rotor axis, and engage in each other by means of their helical contours and each cooperate with compression wall surfaces which are adjacent thereto and partly surround them in order to receive gaseous medium that is supplied by way of a low-pressure chamber arranged in the compressor housing and to discharge the gaseous medium in the region of a high-pressure chamber that is arranged in the compressor housing, wherein the gaseous medium is enclosed in compression chambers that are formed between the helical contours and compression wall surfaces that are adjacent thereto with an inflow volume at low pressure and is compressed to a final volume at high pressure, and two control sliders that are arranged one behind the other in a slider channel of the compressor housing in a direction of displacement parallel to the screw rotor axes and are adjacent to the two screw rotors by means of slider compression wall surfaces and are movable in the direction of displacement, wherein a first control slider of the two control sliders is arranged such that it affects the final volume and a second control slider of the two control sliders is arranged such that it affects the initial volume, wherein, in a combined position with mutually facing end surfaces the first control slider and the second control slider are sealed tightly with each other and are movable together in the direction of displacement and, in a separated position, are positionable at a spacing from one another, forming an intermediate space between the mutually facing end surfaces, wherein the two control sliders take a form in the mutually facing end surfaces such that, in the event of a transfer from the combined position to the separated position, a first throttling gap having a gap width that runs transversely to the direction of displacement is formed in a first transfer position that comes directly after the combined position, the first throttling gap being formed at a location different than the intermediate space.

11. A screw compressor according to claim 10, wherein the first throttling gap is arranged offset in the direction of displacement in relation to the mutually facing end surfaces of the two control sliders.

12. A screw compressor according to claim 10, wherein in the first transfer position the first throttling gap has a smaller gap width than the gap foimed between the end surfaces of the two control sliders.

13. A screw compressor according to claim 10, wherein the gap width of the first throttling gap is present over a span of relative movement between the two control sliders in the direction of displacement that is greater than the gap width of the first throttling gap.

14. A screw compressor according to claim 10, wherein the first throttling gap is delimited by two wall surfaces, of which one is arranged in the end region of the first control slider and another in the end region of the second control slider.

15. A screw compressor according to claim 10, wherein a wall surface that is formed by the end region of the first control slider extends adjacent to the end surface of the first control slider.

16. A screw compressor according to claim 10, wherein a wall surface that is arranged in the end region of the second control slider extends adjacent to the end surface of the second control slider.

17. A screw compressor according to claim 10, wherein at least one of the slider compression wall surfaces extends substantially parallel to the direction of displacement.

18. A screw compressor according to claim 10, wherein the two control sliders take a form in their mutually facing end regions such that, in a second transfer position located between the first transfer position and the separated position, there is formed a second throttling gap having a gap width that runs transversely to the direction of displacement and is greater than the gap width of the first throttling gap.

19. A screw compressor according to claim 18, wherein the second throttling gap is delimited by at least one wall surface that is arranged on a side of a wall surface delimiting the first throttling gap that is remote from the end surface.

20. A screw compressor according to claim 18, wherein the second throttling gap is delimited by a wall surface that also delimits the first throttling gap.

21. The screw compressor of claim 10, wherein a portion of the first control slider axially overlaps a portion of the second control slider to define the first throttling gap in the first transfer position.

22. The screw compressor of claim 21, wherein each of the two control sliders defines a step that mutually axially overlap.

23. A screw compressor, comprising:

a compressor housing having a screw rotor chamber arranged therein, two screw rotors that are arranged in the screw rotor chamber and are mounted on the compressor housing, each rotatably about a respective screw rotor axis, and engage in each other by means of their helical contours and each cooperate with compression wall surfaces which are adjacent thereto and partly surround them in order to receive gaseous medium that is supplied by way of a low-pressure chamber arranged in the compressor housing and to discharge the gaseous medium in the region of a high-pressure chamber that is arranged in the compressor housing, wherein the gaseous medium is enclosed in compression chambers that are foimed between the helical contours and compression wall surfaces that are adjacent thereto with an inflow volume at low pressure and is compressed to a final volume at high pressure, and two control sliders that are arranged one behind the other in a slider channel of the compressor housing in a direction of displacement parallel to the screw rotor axes and are adjacent to the two screw rotors by means of slider compression wall surfaces and are movable in the direction of displacement, wherein a first control slider of the two control sliders is arranged such that it affects the final volume and a second control slider of the two control sliders is arranged such that it affects the initial volume, wherein, in a combined position with mutually facing end surfaces the first control slider and the second control slider are sealed tightly with each other and are movable together in the direction of displacement and, in a separated position, are positionable at a spacing from one another, forming an intermediate space, wherein at least one of the end surfaces of the two control sliders has a sealing edge surface that is adjacent to the slider compression wall surfaces and, on an opposite side of the sealing edge surface to the slider compression wall surfaces, an inner surface that is adjacent to the sealing edge surface and set back in relation thereto, wherein, in the combined position of the two control sliders, the inner surface that is set back from the sealing edge surface forms with an opposing end surface a gap space that is connected to an inflow chamber delimited by the two control sliders in the combined position and is at the same level of pressure as the inflow chamber, wherein the inner surface and the opposing end surface are respectively provided by different members of the two control sliders, and wherein, in the combined position of the two control sliders, the inflow chamber is connected to the low-pressure chamber of the compressor housing in that, in the combined position, an outflow outlet in one of the two control sliders is arranged to overlap with an outflow opening in the slider channel.

24. A screw compressor according to claim 23, wherein the sealing edge surface extends far enough in the direction of the slider channel for the sealing edge surface still to be adjacent to a partial surface of a guide peripheral surface of the respective control slider.

* * * * *